US005383841A

United States Patent [19]

Lilley

[11] Patent Number: 5,383,841

[45] Date of Patent: Jan. 24, 1995

[54] MASSAGING DEVICE

[75] Inventor: Frank M. Lilley, Swanton, Md.

[73] Assignee: Pamela Star Lilley, Swanton, Md.

[21] Appl. No.: 995,753

[22] Filed: Dec. 18, 1992

[51] Int. Cl.[6] ..... A61H 15/00; A61H 7/00

[52] U.S. Cl. ..... 601/128; 601/129; 601/135

[58] Field of Search ..... 128/57–62 R, 128/44; 125/16.01, 21; 51/392, 367; 30/166.3, 340

[56] References Cited

U.S. PATENT DOCUMENTS

| | | | |
|---|---|---|---|
| 681,331 | 8/1901 | Milkman | 128/58 |
| 859,507 | 7/1907 | Murdoch | 128/62 R |
| 863,144 | 8/1907 | Bowser | 128/58 |
| 1,700,633 | 1/1929 | Hendrickson | 128/58 |
| 2,103,261 | 12/1937 | Hughes | 128/57 |
| 2,485,899 | 10/1949 | McBreen | 128/62 R X |
| 3,934,579 | 1/1976 | Brodbeck | 128/57 |
| 3,957,039 | 5/1976 | Ehren | 128/58 |
| 3,970,078 | 7/1976 | Rogers, Jr. | 128/57 |
| 4,210,135 | 7/1980 | Deuser | 128/57 |
| 4,554,911 | 11/1985 | Nielsen | 128/57 |
| 4,870,955 | 10/1989 | Adamak-Hetzel | 128/58 |

FOREIGN PATENT DOCUMENTS

| | | | |
|---|---|---|---|
| 578608 | of 0000 | France | 128/57 |
| 1186841 | 9/1599 | France | 128/58 |
| 1199464 | 12/1959 | France | 128/57 |
| 4175 | 2/1914 | United Kingdom | 128/60 |

*Primary Examiner*—Max Hindenburg
*Assistant Examiner*—Brian E. Hanlon
*Attorney, Agent, or Firm*—Donald A. Kettlestrings

[57] ABSTRACT

A massaging device for stimulating the female genital areas includes a flexible, bow-shaped element having retaining elements at opposite ends thereof. Two strings of beads are positioned adjacent to each other and are removably attached to and extend between the retaining elements.

3 Claims, 1 Drawing Sheet

FIG. 1.
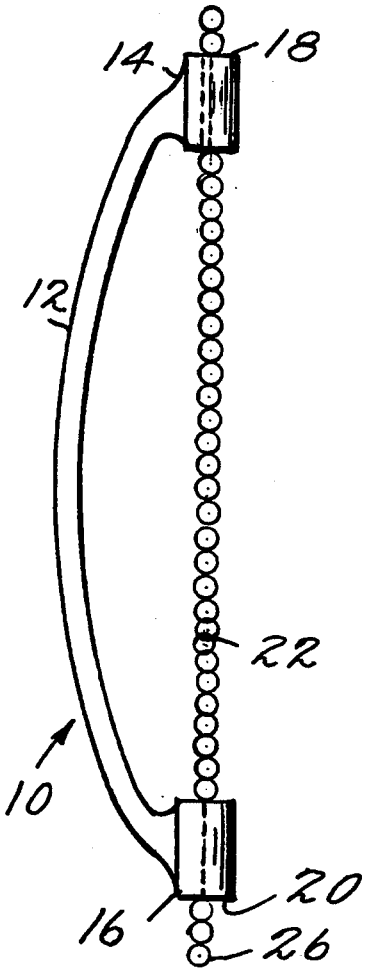
FIG. 2.
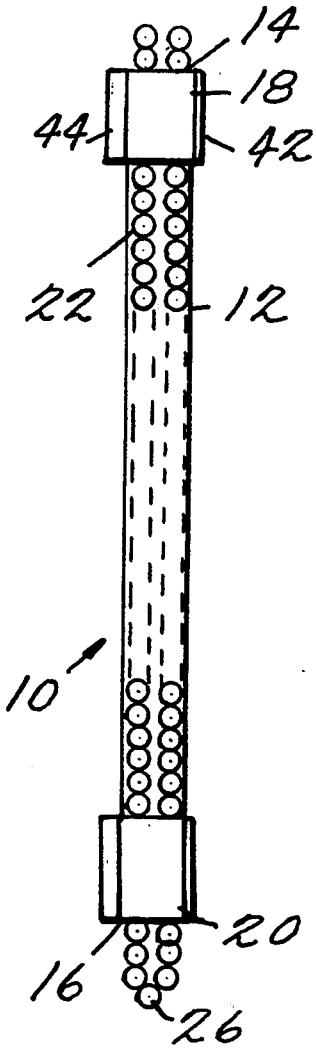
FIG. 3.
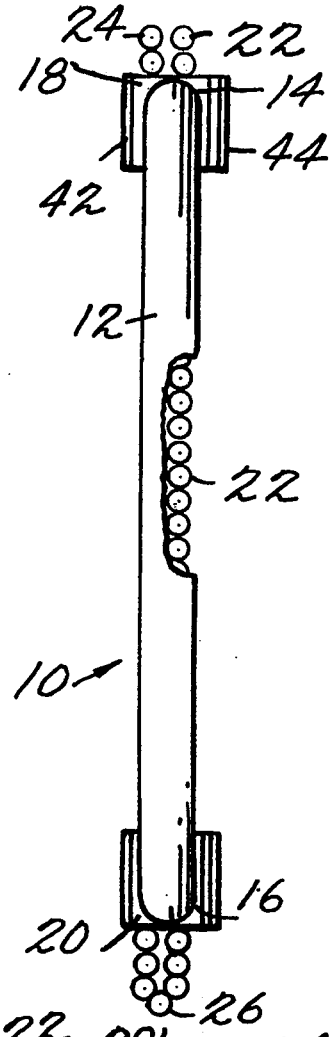
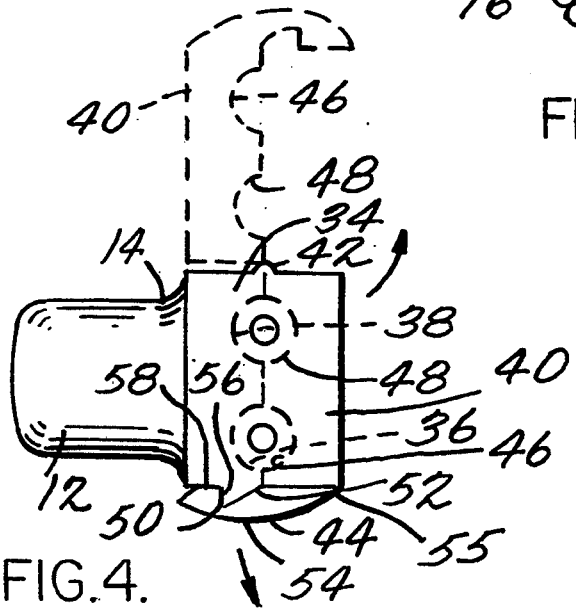
FIG. 4.
FIG. 5.
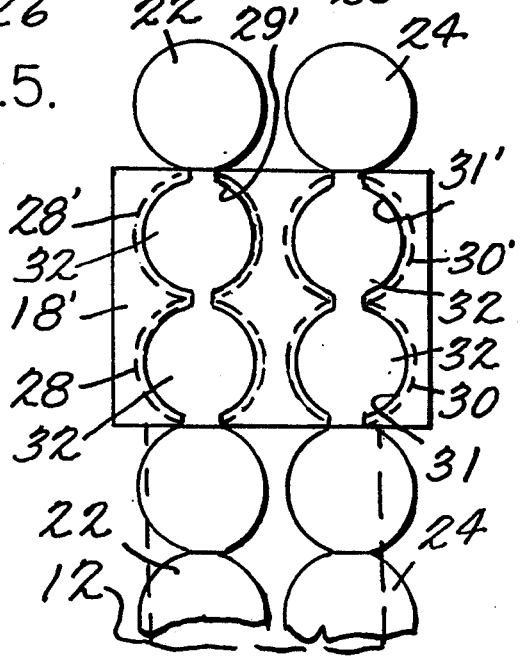

MASSAGING DEVICE

BACKGROUND OF THE INVENTION

This invention relates to a massaging device and more particularly to a massaging device for stimulating the vaginal and clitoral areas.

Various types of massaging devices are known for stimulating the female genital areas, but most of the devices use an electric battery or A.C. electrical power to create a massaging, vibrating and stimulating effect.

SUMMARY OF THE INVENTION

It is, therefore, an object of the invention to provide a manually operable massaging device.

Another object is to provide a manually operated massaging device for massage and stimulation of the vaginal and clitoral areas.

A further object of the invention is the provision of such a massaging device which can be quickly and easily disassembled for cleaning.

Still another object is provide such a massaging device which is sturdy in construction.

A still further object is to provide such a massaging device which is inexpensive and easy to manufacture.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a massaging device which comprises a flexible, bow-shaped element defining first and second opposed distal ends; a first retaining element attached to the bow-shaped element at the first end; a second retaining element attached to the bow-shaped element at the second end; a first string of beads removably attached to and extending between the first retaining element and the second retaining element; and a second string of beads positioned adjacent to the first string of beads, the second string of beads removably attached to and extending between the first retaining element and the second retaining element.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate examples of preferred embodiments of the invention and, together with the description, serve to explain the principles of the invention.

FIG. 1 is a side elevation view of one preferred embodiment of the invention;

FIG. 2 is a front elevation view of the embodiment shown in FIG. 1;

FIG. 3 is a rear elevation view of the embodiment shown in FIG. 1;

FIG. 4 is a top plan view of the embodiment shown in FIG. 1 and illustrating in phantom the open position of the latch cover; and FIG. 5 is a fragmentary front elevation view of another preferred embodiment of the invention.

DESCRIPTION OF THE PREFERRED EMBODIMENTS

With reference now to the drawings, wherein like reference characters designate like or corresponding parts throughout the several views, there is shown a massaging device 10 which comprises a stiff but flexible, bow-shaped element 12 having first and second opposed distal ends 14, 16. A first retaining element 18 is attached to bow-shaped element 12 at first end 14, and a second retaining element 20 is attached to bow-shaped element 12 at second end 16.

A first string of beads 22 is removably attached to and extends between retaining elements 18, 20 and a second string of beads 24 is positioned adjacent to first string of beads 22. Second string of beads 24 is removably attached to and extends between retaining elements 18, 20. Strings of beads 22, 24 may be connected together at connection 26 to form a single strand of beads.

In accordance with one preferred embodiment of the invention as shown in FIG. 5 retaining element 18' defines a plurality of substantially hemispherical cavities 28, 28', 30 and 30', and each of the cavities is sized for receiving a portion of a single one of spherical beads 32 in nesting relationship with the cavity. Each of beads 32 on bead strings 22, 24 is of a predetermined spherical size. Each of cavities 28, 28', 30 and 30' is greater than hemispherical in configuration and defines circular openings 29, 29', 31 and 31', respectively, which are slightly smaller in diameter than the diameters of each of beads 32. This enables single ones of beads 32 to be pressed or snap-fit into and removably retained in nesting relationship within each of cavities 28, 28', 30 and 30'. The retaining element opposed to retainer element 18' is constructed in the same manner as element 18', but the retaining element opposed to retaining element 18' is not illustrated in the drawings.

Another preferred embodiment of the invention is shown in FIGS. 1–4 wherein each of retaining elements 18, 20 comprises a base 34 attached to bow-shaped element 12. Each base 34 defines a plurality of substantially hemispherical cavities 36, 38. A cover 40 is hingedly attached to base 34, and cover 40 defines a second plurality of substantially hemispherical cavities 46, 48 in opposed relationship to cavities 36, 38, respectively, when cover 40 is closed about hinge 42 toward base 34. Latch means 44 are provided in operative relationship with cover 40 and with base 34 for releasably latching cover 40 in closed position with respect to base 34, whereby beads 32 from bead strings 22, 24 are releasably held in nesting positions within cavities 36, 38 and 46, 48 and between base 34 and closed cover 40. Although not shown in the drawings, base 34 and cover 40 may each preferably include additional hemispherical cavities therein for receiving and holding additional beads 32 in nesting relationship within the cavities for firmly holding bead strings 22, 24 in proper position. For example, four cavities can be provided in base 34, in the manner shown in FIG. 5, and four opposing cavities can be provided in cover 40.

Bow-shaped element 12 and retaining elements 18, 18' and 20 are preferably molded and formed from a single piece of plastic to provide strength and desired flexibility. Each of beads 32 is preferably 5/16ths of an inch in diameter, but different size beads can be used, and beads 32 are preferably made of plastic.

When using the invention embodiment shown in FIGS. 1–4, bead strings 22, 24 are attached to retaining elements 18, 20. For example, two of beads 32 within bead strand 22 and adjacent to a first end thereof are positioned one each in nesting relationship within cavity 36 and within another cavity (not shown) that is adjacent to cavity 36 in retaining element 18. Two of beads 32 adjacent to a first end of bead string 24 are then positioned one each in nesting relationship within cavity 38 and within another cavity (not shown) that is adjacent to cavity 38 in retaining element 18. Cavities 36, 38 are sized to snugly receive beads 32 in nesting relationship. Cover 40 of retaining element 18 is then rotated about a thin strip of plastic which acts as hinge 42, and cover 40 is closed toward base 34 so that beads 32 are snugly engaged within cavities 46 and 48 of cover 40. Latch means 44 on cover 40 then engages corresponding latch means 44 on base 34 so that base 34 and cover 40 are held together with beads 32 from bead strings 22, 24 firmly held between base 34 and cover 40. When so enclosed between base 34 and cover 40, beads 32 cannot be pulled through retaining element 18 in any direction.

Although not shown in detail, retaining element 20 in this embodiment of the invention is constructed substantially identically to retaining element 18. To complete the stringing of bow-shaped element 12 with bead strings 22, 24, the free ends of bead strings 22, 24 are pulled toward retaining element 20. The free ends of bead strings 22, 24 are then connected to retaining element 20 in the same manner as previously described with respect to retaining element 18. The tension on bead strings 22, 24 can be controlled by adjusting the tension on the bead strings when the bead strings are connected between retaining elements 18, 20.

As shown in FIG. 4, latch means 44 preferably includes a sharp edged ridge 50 which projects from and extends along edge 52 of base 34. Latch means 44 further preferably includes a protruding element 54 which projects from and extends along edge 55 of cover 40. Element 54 has a sharp edged ridge 56 on an inner surface 58. When cover 40 is in a closed position with respect to base 34, ridge 56 flexibly engages ridge 50 to lock together base 34 and cover 40. To open, a fingernail is placed under protruding element 54 and element 54 is pried or flexed outwardly to release element 54 from ridge 50. Of course, other arrangements can be used to removably fasten cover 40 to base 34.

To string bow-shaped element 12 with bead strings 22, 24 in the embodiment shown in FIG. 5, beads 32 adjacent to a first end of bead string 22 are pressed or snap-fit into cavities 28, 28′ within retaining element 18′. Similarly, beads 32 adjacent to a first end of bead string 24 are pressed or snap-fit into cavities 30, 30′ of retaining element 18′. Because openings 29, 29′, 31 and 31′ are only slightly smaller in diameter than the diameters of beads 32, the beads can be forced through the openings. The beads will be retained within cavities 28, 28′, 30 and 30′ because the cavities are slightly greater than hemispherical in configuration.

After first ends of bead strings 22, 24 have been connected to retaining element 18′, the opposite ends of the bead strings can be similarly connected to the opposite retaining element (not shown). The tension on bead strings 22, 24 can be adjusted and controlled as the bead strings are attached to retaining element 18′ and the retaining element (not shown) opposed to retaining element 18′.

Although each of the retaining elements described with respect to each embodiment is provided with two cavities for receiving beads from each bead string, it should be understood that the device could be provided with only one cavity in each retaining element for receiving a single bead from each bead string. Also, more than two cavities can be provided in each retaining element for receiving beads from each bead string.

In use of both of the embodiments of the invention, after bead strings 22, 24 have been connected to bow-shaped element 12, as previously described, element 12 is grasped in the fingers or hand of the user. Device 10 is positioned with bead string 22 on one side of the clitoris and with bead string 24 on the other side of the clitoris. This effectively squeezes the clitoris between bead strings 22, 24. The user then applies pressure to bow-shaped element 12 toward the clitoris and simultaneously moves bow-shaped element 12 in a sawing motion to cause bead strings 22, 24 to be drawn back and forth along the line of the clitoris and on either side thereof. This creates friction and a bumping, vibrating sensation.

By increasing the force against bow-shaped element 12 toward the clitoris, the tension on bow-shaped element 12 is increased and more pressure is applied to the sides of the clitoris. By decreasing the force against element 12 toward the clitoris, the tension on bow-shaped element 12 is reduced, and bead strings 22, 24 are allowed to move in a manner closely conforming to the shape of the pelvis. As a result, bead strings 22, 24 will come into contact with a larger area of the vagina to provide an increased area of stimulation.

Device 10 is specifically designed to massage and stimulate the clitoral and vaginal areas of the female body and to cause orgasm. Before using device 10, the vaginal area should be lubricated, either naturally or by use of an artificial lubricant. This is to prevent irritation of the delicate tissues. After lubrication, bead strings 22, 24 are placed within the fold of the labia majora, with one string of beads on each side of the hump of the clitoral stem. By moving bow-shaped element 12 up and down in a sawing motion, bead strings 22, 24 will be moved along the line of the clitoral stem. This motion will cause friction and will create a bumping sensation which stimulates the nerve endings that are centered in the clitoris.

By use of retaining elements 18, 20 the tension on bead strings 22, 24 can be tightened or loosened. Tightening of the bead strings will draw them more closely together and when used will cause more pressure against the sides of the clitoris, squeezing it more firmly between bead strings 22, 24. This will create a stronger bumping and vibrating effect. Loosening the tension on bead strings 22, 24 so that they sag slightly between ends 14, 16 of bow-shaped element 12 will allow bead strings 22, 24 to more closely follow the contours of the pelvis. This will cause more of beads 32 within bead strings 22, 24 to be in contact with the vaginal tissues at any given time.

While using device 10, the users free hand can be placed between bow-shaped element 12 and bead strings 22, 24. By applying pressure against the sides of the pubic mound with the fingers, beads 32 within bead strings 22, 24 will become completely engulfed in the fold of the labia majora. This will increase the pressure and friction of the moving beads, thus increasing stimulation.

The invention in its broader aspects is not limited to the specific details shown and described, and departures may be made from such details without departing from the principles of the invention and without sacrificing its chief advantages.

What is claimed is:

1. A massaging device comprising:

a flexible, bow-shaped element defining first and second opposed distal ends;

a first retaining element attached to said bow-shaped element at said first end;

a second retaining element attached to said bow-shaped element at said second end;

a first string of beads removably attached to and extending between said first retaining element and said second retaining element;

a second string of beads positioned adjacent to said first string of beads, said second string of beads removably attached to and extending between said first retaining element and said second retaining element; and each of said first and second retaining elements defining a plurality of substantially hemispherical cavities therein, each of said cavities sized for receiving a portion of a single one of said beads in nesting relationship within said cavity.

2. A massaging device as in claim 1 wherein each of said beads on said first and second string of beads is a predetermined spherical size and wherein each of said cavities is greater than hemispherical in configuration and defines an opening smaller than the diameter of said beads for enabling a single one of said beads to be snap-fit into and removably retained in nesting relationship within said cavity.

3. A massaging device comprising:

a flexible, bow-shaped element defining first and second opposed distal ends;

a first retaining element attached to said bow-shaped element at said first end;

a second retaining element attached to said bow-shaped element at said second end;

a first string of beads removably attached to and extending between said first retaining element and said second retaining element;

a second string of beads positioned adjacent to said first string of beads, said second string of beads removably attached to and extending between said first retaining element and said second retaining element; and each of said first and second retaining elements including:

a base attached to said bow-shaped element and defining a first plurality of substantially hemispherical cavities;

a cover hingedly attached to said base and defining a second plurality of substantially hemispherical cavities in opposed relationship to said first plurality of cavities when said cover is closed toward said base; and latch means in operative relationship with said cover and said base for releasably latching said cover in closed position with respect to said base, whereby beads from said first and second strings of beads are releasably held in nesting positions within said first and second plurality of cavities and between said base and said closed cover.

* * * * *